US007174901B2

(12) United States Patent
Haar et al.

(10) Patent No.: US 7,174,901 B2
(45) Date of Patent: Feb. 13, 2007

(54) CONVERTIBLE PONYTAIL HOLDER/HEADBAND

(76) Inventors: Ashera Haar, 15 Borden Pl., Livingston, NJ (US) 07039; Jeffrey Haar, 15 Borden Pl., Livingston, NJ (US) 07039

( * ) Notice: Subject to any disclaimer, the term of this patent is extended or adjusted under 35 U.S.C. 154(b) by 82 days.

(21) Appl. No.: 11/020,089

(22) Filed: Dec. 23, 2004

(65) Prior Publication Data

US 2006/0137706 A1 Jun. 29, 2006

(51) Int. Cl.
*A45D 8/00* (2006.01)

(52) U.S. Cl. ..... 132/273

(58) Field of Classification Search ..... 132/273, 132/275; 24/115 H, 129 D, 66.9, 129 R; D28/32, 33, 41
See application file for complete search history.

(56) References Cited

U.S. PATENT DOCUMENTS 2,846,688 A * 8/1958 Meeker ..... 2/150
5,167,245 A * 12/1992 Harriett ..... 132/273
5,778,904 A * 7/1998 Elsner ..... 132/275
6,076,532 A 6/2000 Thomas et al.
6,182,672 B1 * 2/2001 Abasta-Douglas et al. .. 132/275
6,213,130 B1 * 4/2001 Alessandrino ..... 132/200
6,484,535 B2 * 11/2002 Grosser-Samuels ..... 63/3
6,675,446 B2 * 1/2004 Buettell ..... 24/122.6
2005/0109361 A1 * 5/2005 Klug ..... 132/275

* cited by examiner

*Primary Examiner*—Todd E. Manahan
*Assistant Examiner*—Rachel A. Running
(74) *Attorney, Agent, or Firm*—Ober/Kaler

(57) ABSTRACT

The device of the present invention is a convertible ponytail holder/headband designed to remain secure during prolonged use and physical activities or when wet. The device includes a long strand of material and a bead with a through-bore. Both ends of the strand are threaded into the through-bore to form a closed loop. The positioning of the bead is adjustable, but remains secure once set due to friction and tension. For optimal friction and tension, the strand is formed of a seamless tubular material that while slightly elastic readily retains its shape. The diameter of the bead through-bore is approximately 0.6 times the width of the strand. In operation, the ponytail holder or headband is looped around a hair bundle or the wearer's head, respectively. To secure the device the bead is moved towards the loop and the loop is tightened.

9 Claims, 2 Drawing Sheets

CONVERTIBLE PONYTAIL HOLDER/HEADBAND

CROSS REFERENCE TO RELATED APPLICATIONS

The present application derives priority from U.S. Provisional Patent Application 60/531,929 for "CONVERTIBLE PONYTAIL HOLDER/HEADBAND", filed Dec. 22, 2003.

BACKGROUND OF THE INVENTION

1. Field of the Invention

The present invention relates generally to fashionable hair holders, fasteners and accessories. Specifically, it relates device that may be used as either a stylish ponytail holder or hair headband.

2. Description of the Background

Ponytail holders and headbands are well known. Substantial segments of the human population, male and female, prefer to let their hair grow long. Devices including ponytail holders, rubber bands, scrunchies, headbands, ribbons, pins, combs, rings, barrettes (also called hair clips) and bobby pins are accessories that are used to gather and hold hair. These devices are used simply to move hair away from the face or to hold fashionable styles such as braids, ponytails or pigtails.

Ponytails or braids are traditionally held in place by rubber bands, ponytail holders, or scrunchies. Rubber bands, however, tangle and pull out hair upon removal. Ponytail holders and scruchies are essentially elastic bands covered with fabric or other such material and are designed specifically to overcome the problem of tangling. However, because they must be removed by pulling them over the hair, hair is often pulled out (just not to the same extent as with rubber bands). Additionally, ponytail holders often slip when the user is engaged in physical or sports activities, requiring constant readjustments to move the ponytail holder back into place or to tighten it. This is particularly the case when the user engages in underwater activities, or other activities in which the ponytail holder might get wet, because the water reduces the friction created between the fabric and the user's hair.

Hair clips may be used to hold a ponytail or braid. However, these clips are typically limited in the diameter size of the bundle of hair, if the device is too large it will slip and if it is too small it will either not hold the hair or be uncomfortable. In addition, wearing some of these devices in water is impractical because they are often formed with metal which may rust and/or glue which may lose its adhesive properties.

Hair headbands traditionally comprise either a horseshoe-shaped band of resilient hard material (i.e. plastic) or circular band of elasticized fabric are well known. The horseshoe shaped headbands are often insufficient to restrain and holdback thick or heavy hair and regularly require readjustment. Additionally, headaches are often experienced by the wearers of such horseshoe shaped headbands because the sides of the headband exert constant pressure against the sides of the wearer's head. Circular headbands on the other hand often bunch hair at the nape of the neck up in an unattractive manner. Prior art headbands often fail to restrain a wearer's hair effectively, and, to the frustration of the wearer, the bands frequently require readjustment. Also, in these modern times, the prior art headbands are perceived as aesthetically unattractive in by some age groups and for men.

U.S. Pat. No. 6,076,532 to Thomas et al. issued Jun. 20, 2000 disclosed a combination head/hair band and hair gathering device. The devise is comprised of a flexible textile cord with two slides. The ends of the cord are routed through the first slide and then the second slide to form two adjacent loops. Friction enables the slides to remain in place, while also being adjustable if necessary. The first loop is "adapted to be placed on the head of a person" and the second is "adapted to surround a ponytail". The textile material used is long, braided (for friction), relatively thick and therefore bulky and heavy. The diameter of the hollow passage of the bead relative to the diameter of the cord (1.1–1.7 times) in combination with the materials used does not ensure that the headband/ponytail holder will remain secure during physical activities or when wet. Furthermore, the dual purpose limits the position of the ponytail to the nape of the neck and leaving hair bunched in an uncomfortable position.

Thus, there is a need for a convertible ponytail holder that (1) adequately holds all types of hair even when the user is engaging in sports or underwater activities, (2) does not pull or tangle hair upon removal or repositioning, (3) does not require constant readjustment, (4) does not cause headaches, (5) does not cause hair to bunch up in an unattractive manner, (6) is suitable for use as a ponytail holder at any position on the head, (7) is convertible into a headband, and (8) is aesthetically pleasing.

SUMMARY OF THE INVENTION

The principal objective of the present invention is to provide a ponytail holder that remains secure for prolonged time periods without requiring frequent readjustments to tighten or reposition.

Another object of the present invention is to provide such a ponytail holder that is adjustable in order to secure and hold ponytails of a wide variety of thicknesses.

It is a further object of the present invention to provide such a ponytail holder that remains secure when the user engages in physical or sports activities, including swimming or other under water activities in which the device might get wet.

It is further object of the present invention to provide such a ponytail holder that does not inflict a headache upon or otherwise cause discomfort to the wearer.

A secondary objective is to provide a headband that that remains secure for prolonged time periods without requiring frequent readjustments to tighten or reposition.

Another object of the present invention is to provide such a headband that is adjustable to fit the size and shape of a wide variety of heads.

Yet another object of the present invention is to provide such a headband that remains secure when the user engages in physical or sports activities, including swimming or other under water activities.

It is further object of the present invention to provide such a headband that does not inflict a headache upon or otherwise cause discomfort to the wearer.

A further objective of the present invention is to provide such a headband that is exceedingly durable but also aesthetically pleasing.

Lastly, it is an object of the present that the device of the present invention is convertible for use as either a ponytail holder or a headband.

The foregoing objects of the present invention are accomplished by a providing a device that comprises a single strand of material and a bead. Specifically, both ends of the material are fed through a hollow center passage of a bead to form a loop. In the case of a ponytail holder a bundle of hair is pulled through the loop. In the case of a headband, the head is placed through the loop, set at the desired position and the hair is pulled through. The ponytail holder or headband is secured by tightening the loop. The loop is tightened either by holding the ends of the strand together and sliding the bead towards the hair bundle or head or by pulling out on both ends of the strand simultaneously such that the bead is forced towards the hair bundle or head. Friction and tension holds the bead securely in place along the strand.

Adequate friction is established by using a bead of plastic, glass, metal or other material and a strand of seamless poly-cotton or poly-nylon material with sufficient elasticity to allow bending but not overstretching, whereby the diameter of the internal hollow passage of the bead is significantly smaller than the diameter of the single strand. The objects of the present invention may also be accomplished by substituting seamed material and/or multiple smaller diameter strands of material for the single strand to produce the same desired effect.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE INVENTION

Figure 1:
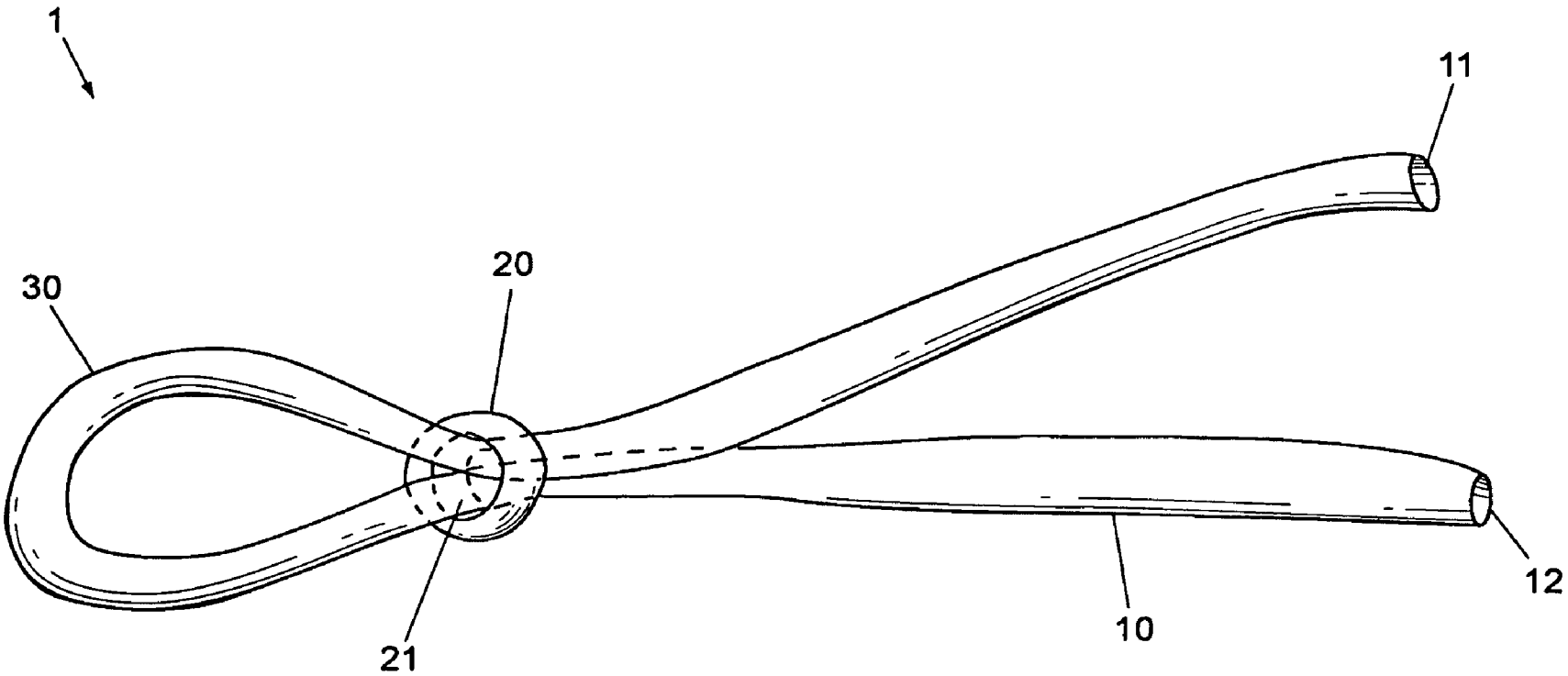
FIG. 1 is a drawing of the preferred embodiment of the device 1 of the present invention including a single strand and bead.
Figure 3:
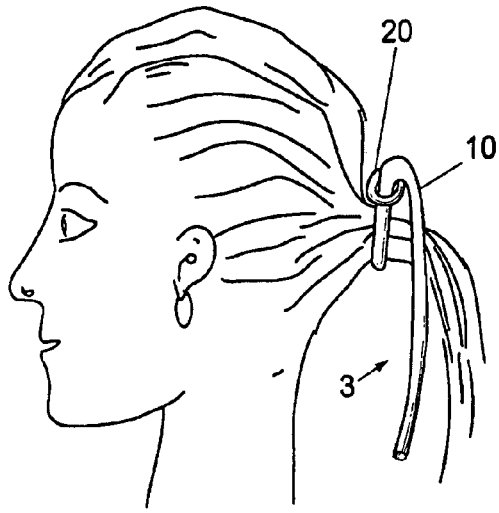
FIG. 3 is a side view drawing illustrating the device of FIG. 1 in use as a ponytail holder.
Figure 4:
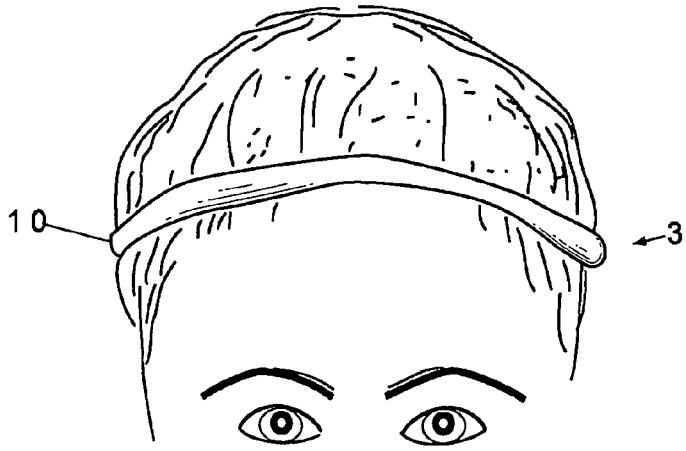
FIG. 4 is a front view drawing illustrating the device of FIG. 1 in use as a headband.

FIG. 1 illustrates the device 1 of the present invention, setting out the two primary components, the strand 10 and the bead 20. Depending upon the length of strand 10, the device may be alternately and selectively used as a ponytail holder 2 (FIG. 2), or as either a ponytail holder or a headband (convertible ponytail holder/headband 3), (FIGS. 3 and 4, respectively). For the purposes of this invention a ponytail holder is a defined as a device that secures bundles of hair including but not limited to ponytails, pigtails, and braids.

The bead 20 is held in place on the strand 10 due to the friction and tension between the two components. The materials for the strand 10 and bead 20, as well as their structure are specifically designed to produce and maintain sufficient friction and tension between the two components even after prolonged use or when wet.

Referring back to FIG. 1, the device 1 of the present invention includes a seamless, tubular strand 10 of poly-cotton or poly-nylon material. Those skilled in the art will recognize that other suitable materials may be used. The material must be flexible with a slight degree of elasticity to hold hair with out pulling, tangling, or otherwise causing discomfort. It must also maintain its shape and its frictional properties after prolonged use, during physical or sports activities and when wet. The tubular, seamless structure of the strand is specifically designed to increase the surface area in contact with the bead to increase friction and tension.

Figure 2:
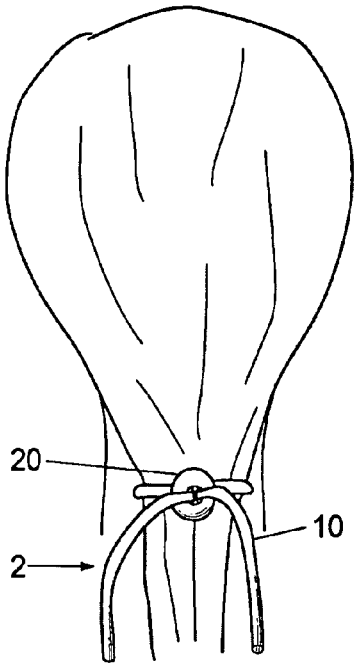
FIG. 2 is a rear view drawing illustrating the device of FIG. 1 in use as a ponytail holder.

As shown in FIG. 2, a strand length of approximately 65 cm (25 inches) or greater makes the device suitable for use as a convertible ponytail holder/headband 3. One skilled in the art will recognize that these suggested lengths are suitable for adults and may vary when the device is adapted for use by children. The strand 10 includes two opposing ends 11 and 12.

Bead 20 may be made from any number of suitable materials including glass, plastic, wood, or metal, depending on fashion and style preference. As shown in FIG. 1, the bead 20 is ring shaped. However, those skilled in the art will recognize that the bead 20 may vary in size, shape and color depending on fashion preference, and may take the form of a ring. Regardless of its size, shape or color, bead 20 is further defined by a cylindrical through-bore 21 through which both ends 11 and 12 of strand 10 are threaded, to form a single closed loop 30. The optimal length and diameter of this through-bore 21 are functions of the width of the strand 10 (as measured when the preferred tubular strand is flattened). The optimal degree of friction and tension between the bead and the strand is produced when the diameter of the through-bore is approximately 0.6 times the width of a single strand 10 and the length of the through-bore 21 is approximately 1.7 the width of a single strand. To reduce weight and bulkiness of the device and, thereby prevent discomfort and headaches, the optimal width of the strand is 2–5 mm. Therefore, for a strand 10 with a 5 mm width, the optimal diameter and length of the through-bore 21 are approximately 3 mm and 1 cm respectively.

When using the device 1 of the present invention as a ponytail holder (FIGS. 2 and 3, reference numbers 2 or 3), the user's hair is gently pulled through loop 30 to form a bundle (i.e. ponytail). When using the device 3 as a headband (FIG. 4, reference number 3), the user's head is placed through the loop 30, the device is set around the user's head at a desired position and optionally hair is pulled through the loop 30. The device 3 is secured by tightening the loop 30, either by holding the ends (11 and 12) of the strand together and sliding the bead 20 towards the hair bundle or head or by pulling ends 11 and 12 in opposite directions simultaneously such that the bead is forced towards the hair bundle or head. The loop 30 is tightened to such a degree that it exerts sufficient pressure on the hair bundle to resist movement but not so much pressure as to cause headaches or otherwise cause discomfort to the user.

We claim:

1. A convertible ponytail holder/headband for holding bundles of hair, comprising:

a bead having a central through-bore of pre-determined diameter; and a hollow tubular strand of flexible seamless elastic material having a predetermined width and an uncompressed cross-sectional diameter larger than said predetermined diameter of the through-bore of said bead, said strand being doubled over to form a loop, and said loop being inserted end-wise through the through-bore of said bead;

whereby said ponytail holder is used by gently pulling a bundle of hair through the exposed loop of said strand and by constricting said loop by frictionally sliding the bead.

2. The ponytail holder of claim 1, whereby said strand is within a range of from 30–65 cm long.

3. The ponytail holder of claim 1, whereby said strand is at least 65 cm long for convertible use as a ponytail holder and a headband.

4. The ponytail holder of claim 1, whereby said strand of flexible elastic material is tubular with an uncompressed cross-sectional diameter within a range of from 2 to 5 mm.

5. The ponytail holder of claim 1, whereby the diameter of the through-bore in said bead is approximately 0.6 times the uncompressed cross-sectional diameter of the strand.

6. The ponytail holder of claim 1, whereby the length of the through bore is approximately 1.7 times the uncompressed cross-sectional diameter of the strand.

7. The ponytail holder of claim 1, whereby the uncompressed cross-sectional diameter of said strand is approximately 5 mm, and the diameter and length of the through-bore in said bead are approximately 3 mm and 1 cm respectively.

8. The ponytail holder of claim 1, whereby the bead is a ring.

9. The ponytail holder of claim 1, whereby said bead has one or more holes for through-bore.

* * * * *